US005952973A

United States Patent [19]

Uematsu et al.

[11] Patent Number: 5,952,973

[45] Date of Patent: Sep. 14, 1999

[54] PLANAR ANTENNA MODULE

[75] Inventors: Hiroshi Uematsu; Hiroshi Kudoh; Masanobu Urabe, all of Wako, Japan

[73] Assignee: Honda Giken Kogyo Kabushiki Kaisha, Tokyo, Japan

[21] Appl. No.: 08/827,572

[22] Filed: Mar. 28, 1997

[30] Foreign Application Priority Data

Apr. 1, 1996 [JP] Japan ..... 8-079152

[51] Int. Cl.[6] ..... H01Q 1/36

[52] U.S. Cl. ..... 343/700 MS; 343/853

[58] Field of Search ..... 343/700 MS, 853, 343/850, 777, 893; 342/368, 372, 373; H01Q 1/36

[56] References Cited

U.S. PATENT DOCUMENTS 4,742,354 5/1988 Wen et al. ..... 343/700 MS
4,933,680 6/1990 Shapiro et al. ..... 343/700 MS

*Primary Examiner*—Hoanganh Le
*Attorney, Agent, or Firm*—Lyon & Lyon LLP

[57] ABSTRACT

A single dielectric substrate having formed thereon a plurality of planar antenna elements, and a ferrite substrate provided with a circulator are joined together to form a planar antenna module of an integral construction. The planar antenna elements are each composed of a patch formed by a thick or a thin film deposition technique. In one preferred form of joining, the dielectric substrate and the ferrite substrate are joined together at one side. In another preferred form of the joining, the ferrite substrate is fitted or assembled in an opening or window formed in the dielectric substrate.

5 Claims, 5 Drawing Sheets

PLANAR ANTENNA MODULE

BACKGROUND OF THE INVENTION

1. Field of the Invention

The present invention relates generally to a planar antenna module for a millimeter-wave radar system for use on motor vehicles. More particularly, it relates to a planar antenna module which is capable of integrating a plurality of planar antenna elements and a plurality of circulators in a limited mounting or packaging space and which is suitable for a motor vehicle millimeter-wave radar system for wide scanning angular range and high bearing resolution.

2. Description of the Related Art

The present inventors have proposed "a radar module and an antenna device" for an FM millimeter-wave radar system for use on motor vehicles, as described in the co-pending U.S. patent application Ser. No. 08/611,665 and European Patent Application No. 96104536.6.

The motor vehicle millimeter-wave radar system includes an offset defocused parabolic antenna composed of a primary radiator of a deafest multiple-beam antenna including planar array antenna elements, and a secondary radiator having a parabolic reflecting surface. Electromagnetic waves in a millimeter wavelength range which are radiated from the planar array antenna elements of transmitting and receiving channels are radiated by the secondary reflector at respective different angles or bearings in a horizontal direction forwardly of a motor vehicle. Some of the electromagnetic waves are reflected by objects, travel back along the reverse course of the radiation, and are received by the planar array antenna elements for subsequent signal processing operation by which distances to the objects which have produced the reflected waves in the respective transmitting and receiving channels (bearings) are calculated to make up a two-dimensional map of obstacles in the forward direction of the motor vehicle.

FIG. 7 shows the structure of the "FM radar module-"described in the specification of the co-pending applications specified above.

In FIG. 7, the FM radar module 50 includes MMICs (monolithic microwave integrated circuits) 53A–53H, circulators 54A–54P for separating signals to be transmitted and signals received, and planar array antenna elements 52A–52P, all the components being provided on a common dielectric substrate 51.

The MMICs 53A–53H each include a transmitting portion and a receiving portion on a single semiconductor substrate. The respective transmitting portions amplify high-frequency signals supply the respective planar array antenna elements 52A–52P with transmitted signals. Each of the receiving portion is provided with an amplifier for amplifying a local signal, and a mixer for mixing the amplified local signal with a signal received by a corresponding one of the planar array antenna elements 52A–52P.

The antenna assembly 52 is composed of a plurality of rectangular patches spaced a predetermined distance. The planar array antenna elements 52A–52P each corresponding to one of a plurality of transmitting and receiving channels are divided into two groups. The planar array antenna elements 52A–52H of one group and the planar array antenna elements 52I–52P of the other group are arranged in interdigitating pattern and extend in opposite directions that are 180 degrees apart from each other.

In the motor vehicle millimeter-wave radar system, the resolution in a horizontal direction of the two-dimensional map is determined by the number of planar antenna elements employed for transmitting and receiving electromagnetic waves. Accordingly, in order to generate a high-resolution two-dimensional map, a greater number of planar antenna elements and circulators should be integrated on the dielectric substrate.

SUMMARY OF THE INVENTION

In view of the foregoing, an object of the present invention is to provide a planar antenna module which is capable of integrating a plurality of planar antenna elements and a circulator on a dielectric substrate at a high integration density and hence is suitable for use in a high resolution motor vehicle radar system.

A planar antenna module of the present invention includes a single dielectric substrate having formed thereon a plurality of planar antenna elements. The dielectric substrate and a ferrite substrate provided with a circulator are integrally joined together to form an integral or unitary unit. With this construction, since the planar antenna elements and the circulator are mounted or packed on the same dielectric substrate, signals to be transmitted and signals received can be separated at a high degree of separation. Furthermore, since the planar antenna elements and the circulator are integrated on the same dielectric substrate, the planar antenna module is suitable for a high resolution radar system. By virtue of the integral formation of the dielectric substrate and the ferrite substrate, feeder lines for connecting the planar antenna elements and the circulator can be formed uniformly, which will improve the impedance matching between the planar antenna element side and the circulator side and insure transmission of high-frequency waves with reduced transmission losses. The planar antenna module is, therefore, able to operate with improved stability. In one preferred form of the present invention, one side of the dielectric substrate is integrally joined with one side of the ferrite substrate. In another preferred form of the present invention, the ferrite substrate is fitted or assembled in an opening or window formed in the dielectric substrate.

The present invention further provides a planar antenna module which includes a plurality of planar antenna elements provided on a single dielectric substrate, and a circulator formed by joining or attaching two ferrite pieces, together with two magnets, to opposite surfaces of the dielectric substrate at a portion including a feeder line for the planar antenna elements. Since the planar antenna elements and the circulator are mounted or packaged on the same dielectric substrate, signals to be transmitted and signals received can be separated at a high separation rate.

In the planar antenna module of the present invention, the planar antenna elements are each composed of a patch element of a conductive pattern formed on the dielectric substrate by a thick or a thin film deposition technique. Since the patch elements thus formed can be readily arranged, at a desired position and in a desired pattern, on the dielectric substrate, the degree of integration density of the planar antenna elements can be increased.

In one preferred form of the present invention, a plurality of sets of planar antenna elements, each set including a plurality of planar antenna elements connected in series with each other, and a corresponding number of circulator connected in series with the respective planar antenna element sets are arranged in plural rows on a single dielectric substrate such that DC magnetic fields in mutually opposite directions are applied to the adjacent circulators. The application of DC magnetic fields in mutually opposite directions is effective to cancel these DC magnetic fields and prevent a DC magnetic field from being generated. This arrangement makes it possible to increase the integration density of the planar antenna elements.

The above and other objects, features and advantages of the present invention will become more apparent from the following description when making reference to the detailed description and the accompanying sheets of drawings in which preferred structural embodiments incorporating the principles of the present invention are shown by way of illustrated example.

DETAILED DESCRIPTION OF THE PREFERRED EMBODIMENTS

Figure 1:
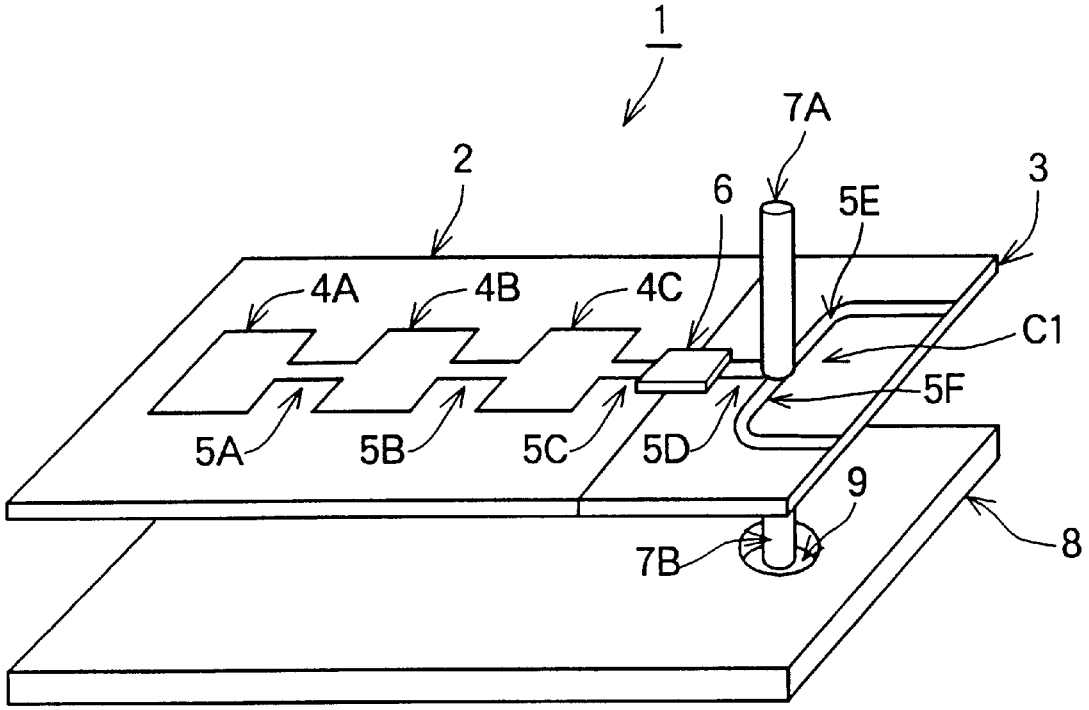
FIG. 1 is a perspective view showing the construction of a planar antenna module according to a first embodiment of the present invention.

As shown in FIG. 1, a planar antenna module 1 according to a first embodiment of this invention includes a dielectric substrate 2, a ferrite substrate 3 joined to one side of the dielectric substrate 2, a plurality of planar antenna elements 4A–4C formed on the dielectric substrate 2, a plurality of feeder lines 5A–5F, a strip-like metallic connector 6, two magnets 7A, 7B, and a metallic base plate 8.

The planar antenna module 1, in one preferred form of the invention, is a planar antenna composed of three rectangular patches 4A, 4B and 4C formed by a thick or a thin film deposition technique on the dielectric substrate 2 of alumina ceramic, for example.

The three rectangular patches 4A, 4B, 4C on the dielectric substrate 2 are interconnected by the feeder lines 5A, 5B formed on the same dielectric substrate 2 by the thick or the thin film deposition technique.

The feeder line 5D for connection with the planar antenna element 4C, the feeder line 5E for feeding signals to be transmitted to the planar antenna elements, and the feeder line 5F for feeding received signals from the planar antenna elements to MMICs (monolithic microwave integrated circuits), not shown, are formed on the ferrite substrate 3 by the thick or the thin film deposition technique. Alternatively, the feeder line 5E may be used in combination with the received signals, and the feeder line 5F with the signals to be transmitted.

A circulator C1 is composed of the ferrite substrate 3, the feeder lines 5D, 5E, 5F formed on the ferrite substrate 3, and the magnets 7A, 7B. In the circulator C1, the junction between the feeder lines 5D, 5E, 5F is gripped or sandwiched by the magnets 7A, 7B from above and below. A DC magnetic field is applied via the magnets 7A, 7B to the junction between the feeder lines 5D, 5E, 5F so that the transmitted signals inputted into the feeder line 5E are fed exclusively to the feeder line 5D, and the received signals from the planar antenna elements 4A, 4B, 4C inputted into the feeder line 5D are fed exclusively to the feeder line 5F. Thus, the degree of separation of the transmitted signals and the received signals is improved.

The dielectric substrate 2 carrying thereon the planar antenna elements and the ferrite substrate 3 forming a part of the circulator C1 are secured to the metallic base plate 8, with one side of the dielectric substrate 2 being joined with one side of the ferrite substrate 3, and with feeder line 5D on the dielectric substrate 2 and the feeder line 5D on the ferrite substrate 3 being connected by the strip-like metallic connector 6. The metallic base plate 8 has a hole or opening 9 through which the magnet 7B extends.

In the planar antenna module 1 thus constructed, the dielectric substrate 2 carrying thereon the planar antenna elements 4A, 4B, 4C, and the ferrite substrate 3 forming a part of the circulator Cl are joined with each other and then set on the single metallic base plate 8. It is, therefore, possible to integrate a plurality of planar antenna elements and a circulator on a single metallic base plate 8 at a high integration density. This integration will increase the resolution in a horizontal direction of a two-dimensional map of a motor vehicle millimeter-wave radar system in which the planar antenna module 1 is incorporated.

Figure 2:
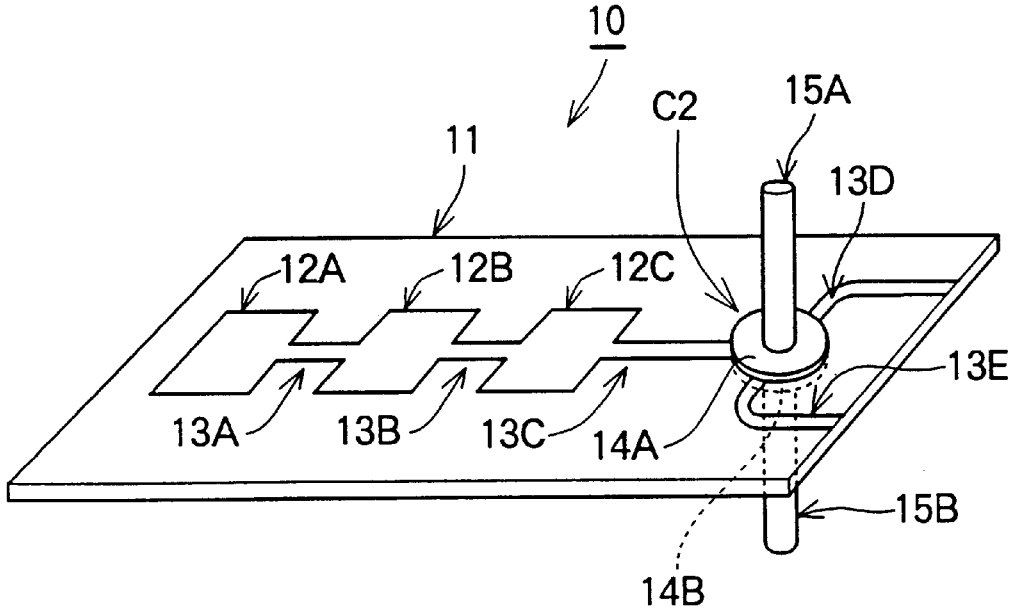
FIG. 2 is a perspective view showing the construction of a planar antenna module according to a second embodiment of the present invention.

FIG. 2 shows in perspective a planar antenna module according to a second embodiment of the present invention.

As shown in FIG. 2, the planar antenna module 10 is comprised of a dielectric substrate 11, a plurality of planar antenna elements 12A–12C, a plurality of feeder lines 13A–13E, two ferrite pieces 14A and 14B, and two magnets 15A and 15B.

The planar elements composed of three rectangular patches 12A, 12B, 12C and the feeder lines 13A, 13B, 13C, 13D, 13E are formed by a thick or a thin film deposition technique on the dielectric substrate of aluminum ceramic, for example. At a feeder portion leading to the planar antenna elements, a circulator C2 composed of the ferrite pieces (being in the form of a disk) 14A, 14B and the magnets 15A, 15B is formed by joining or bonding on the dielectric substrate 11. Thus, a single dielectric substrate 11 carries thereon a plurality of planar antenna elements, a plurality of feeder lines, and a circulator. More specifically, the circulator C2 is constructed such that the ferrite disks 14A, 14*b* grip or sandwich the dielectric substrate 11 from above and below at a portion including the junction between three feeder lines 13C, 13D, 13E, and the magnets 15A, 15B are attached to the ferrite disks 14*a*, 14B, respectively, from a direction perpendicular to respective planes of the ferrite disks 14A, 14B.

In the planar antenna module 10 shown in FIG. 2, since the planar antenna elements 12A, 12B, 12C and the circulator C2 jointly forming a portion for processing high-frequency waves are mounted or packaged on the same dielectric substrate 11 without using a strip-like metallic connector shown in FIG. 1, the impedance matching between the planar antenna element side and the circulator side is improved, thus insuring a stable electric operation of the planar antenna module 10. With this construction, an additional improvement in the degree of separation between the transmitted signals and the received signals at the circulator C2 can be provided.

As described above, the planar antenna module 10 of the second embodiment includes a plurality of planar antenna elements 12A–12C on a single dielectric substrate 11. Two ferrite disks 14A, 14B and two magnets 15A, 15A are joined on opposite surfaces of the dielectric substrate 11 at a feeder portion of the planar antenna elements 12A–12C so as to form a circulator C2. Since the planar antenna elements 12A–12C and the circulator C2 are mounted or packaged on the same dielectric substrate 11, it is possible to integrate a plurality of planar antenna elements and a circulator on a single dielectric substrate.

Figure 3:
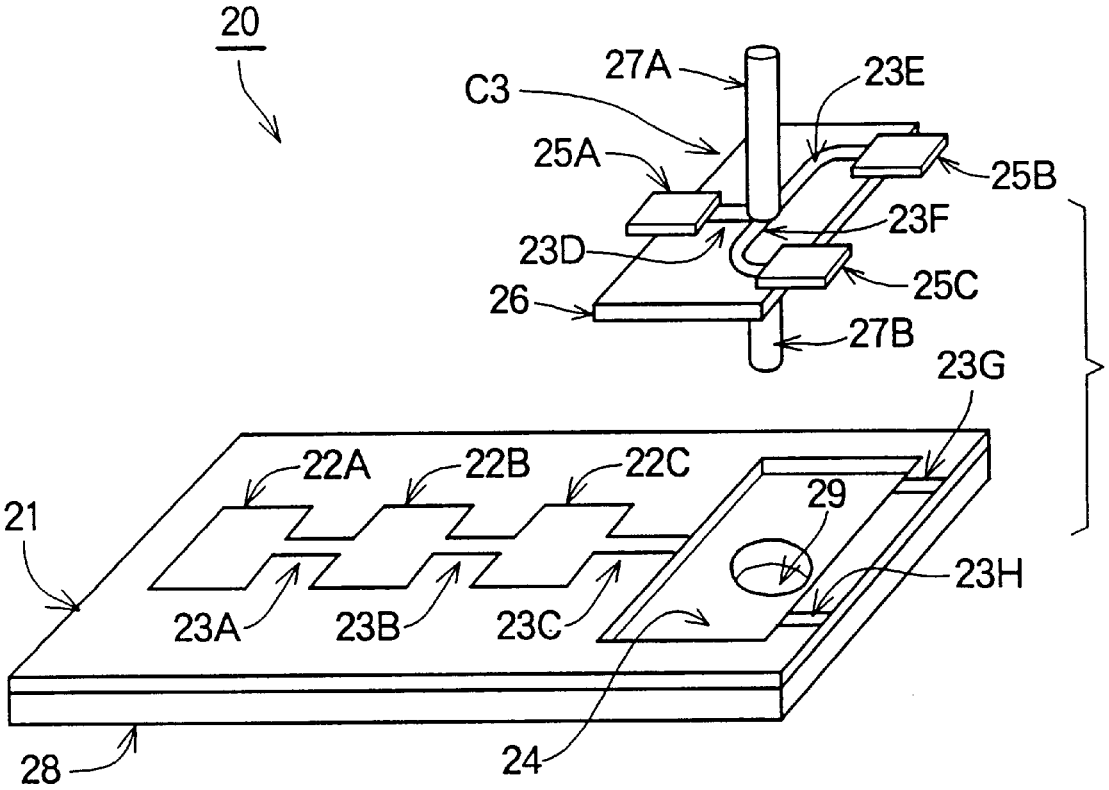
FIG. 3 is a perspective view showing the construction of a planar antenna module according to a third embodiment of the present invention.

FIG. 3 shows the construction of a planar antenna module according to a third embodiment of the present invention.

As shown in FIG. 3, the planar antenna module 20 includes a dielectric substrate 21, a plurality of planar antenna elements 22A–22C, a plurality of feeder lines 23A–23H, a plurality of strip-like metallic connectors 25A–25C, a ferrite substrate 26, two magnets 27A, 27B, and a single metallic base plate 28.

The planar antenna elements composed of three rectangular patches 23A, 23B, 23C and five feeder lines 23A, 23B, 23C, 23G, 23H are formed by a thick or a thin film deposition technique on the dielectric substrate 21 of alumina ceramic, for example.

The feeder lines 23D, 23E, 23F formed on the ferrite substrate 26 by the thick or the thin film deposition technique, and the magnets 27A, 27B jointly form a circulator C3. The circulator C3 is fitted or assembled in a rectangular opening or window 24 formed in the dielectric substrate 21 at a feeder portion for the planar antenna elements 22A–22C. The feeder line 23D on the ferrite substrate 26 is connected to the feeder line 23C on the dielectric substrate 21 via the strip-like metallic connector 25A. Similarly, the feeder line 23E is connected via the metallic connector 25B to the feeder line 23G, and the feeder line 23F is connected via the metallic connector 25B to the feeder line 23H.

The planar antenna elements composed of three rectangular patches 22A, 22B, 22C and five feeder lines 23A, 23B, 23C, 23G, 23H are formed on the dielectric substrate 21. The dielectric substrate 21 is mounted on the single metallic base plate 28 while the circulator C3, which is composed of the feeder lines 23D, 23E, 23F formed on the ferrite substrate 26 and the magnets 27A, 27B, is assembled in the window 24 in the dielectric substrate 21. The metallic base plate 28 has a hole or opening 29 through which the magnet 27B extends.

Since the ferrite substrate 26 is integrally assembled with the dielectric substrate 21 in a buried or embedded manner, the circulator C3 shown in FIG. 3 is able to perform separation of transmitted signals and received signals with increased reliability.

As described above, the planar antenna module 20 of the third embodiment includes a plurality of planar antenna members 22A–22C provided on a single dielectric substrate 21. A circulator C3 including a ferrite substrate 26 is assembled in a window 24 formed in the dielectric substrate 21 at a feeder portion for the planar antenna elements. The the dielectric substrate 21 is mounted on a single metallic base plate 28, with the circulator C3 integrally assembled with the dielectric substrate 21. With this construction, it is possible to integrate a plurality of planar antenna elements and a circulator on a single metallic base plate.

Figure 4:
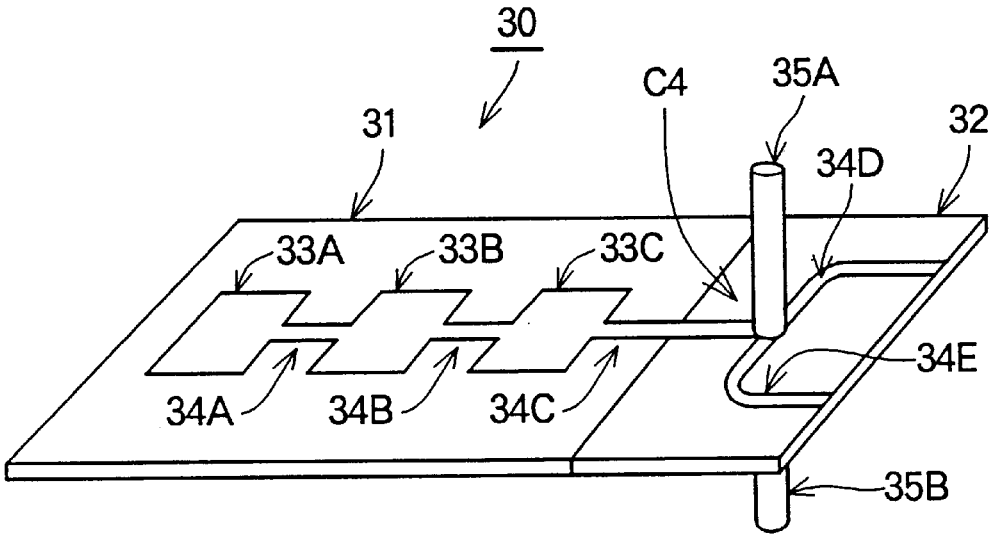
FIG. 4 is a perspective view showing the construction of a planar antenna module according to a fourth embodiment of the present invention.

FIG. 4 shows the construction of a planar antenna module according to a fourth embodiment of the present invention.

As shown in FIG. 4, the planar antenna module 30 is comprised of a dielectric substrate 31, a ferrite substrate 32, a plurality of planar antenna elements 33A–33C, a plurality of feeder lines 44A–44E, and two magnets 45A, 45B.

Figure 5:
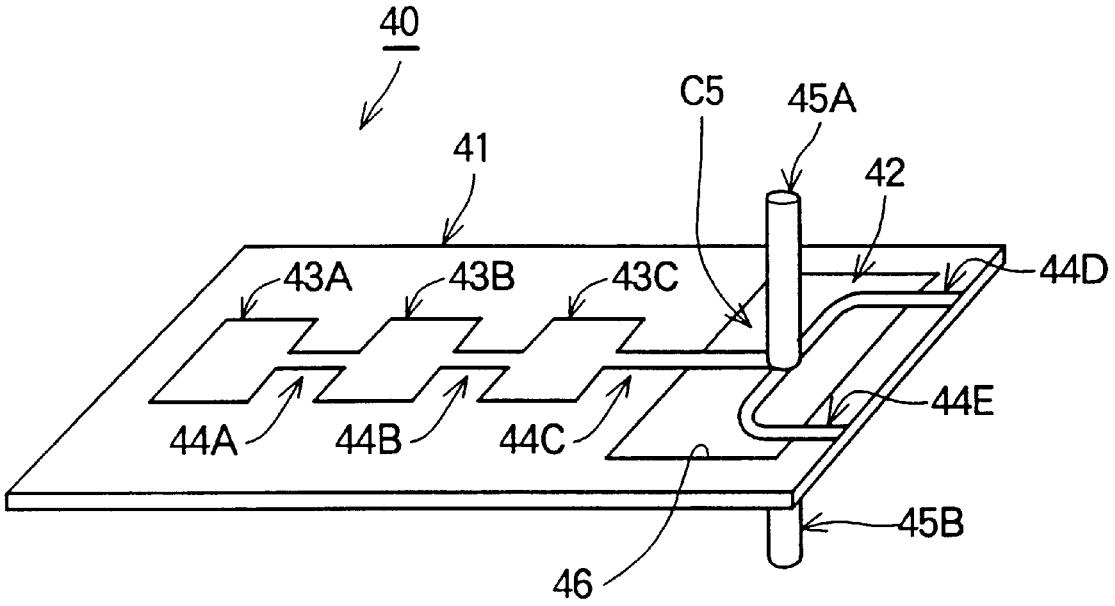
FIG. 5 is a perspective view showing the construction of a planar antenna module according to a fifth embodiment of the present invention.

FIG. 5 illustrates the construction of a planar antenna module according to a fifth embodiment of the present invention.

As shown in FIG. 5, the planar antenna module 40 includes a dielectric substrate 41, a ferrite substrate 42, a plurality of planar antenna elements 43A–43C, a plurality of feeder lines 44A–44E, and two magnets 45A, 45B.

In the planar antenna module 30 shown in FIG. 4, the dielectric substrate 31 and the ferrite substrate 32 are formed integrally with each other by joining them together at one side thereof. The planar antenna module 40 shown in FIG. 5 has a structural feature that the dielectric substrate 41 and the ferrite substrate 42 are formed integrally with each other by assembling the ferrite substrate 42 into a rectangular opening of window 46 which is formed in the dielectric substrate 41 at a portion including the feeder line 44C leading to the planar antenna element 43C.

In the planar antenna modules 30, 40 respectively shown in FIGS. 4 and 5, the planar antenna elements 33A–33C; 43A–43C and the ferrite substrate 32; 42 having a circulator C4; C5, that jointly form a portion taking part in the processing of high-frequency waves, are integrally formed with each other without using a strip-like metallic connector or connectors 6; 25A–25C such as shown in FIGS. 1 and 3. With this integral or unitary construction, the impedance matching between the planar antenna element side and the feeder portion side (circulator side) is improved, thus insuring a stable operation of the planar antenna module 30; 40. The circulator C4; C5 is able to separate transmitted signals and received signals at an increased separation rate.

In other words, since the dielectric substrate 31; 41 carrying thereon the planar antenna elements 33A–33C; 43A–43C and the ferrite substrate 32; 42 having formed thereon the circulator C4; C5 are formed integrally with each other by joining them together, and since the planar antenna elements 33A–33C; 43A–43C and the circulator C4; C5 are connected by a uniform feed line or lines 34C; 44C–44E formed by a thick or a thin film deposition technique without the use of a strip-like metallic connector or connectors 6; 25A–25C, the planar antenna modules 30, 40 shown in FIGS. 4 and 5 are able to improve the impedance matching between the planar antenna elements 33A–33C; 43A–43C and the circulator C4; C5 and to transmit highfrequency wave signals with reduced transmission losses.

Figure 6:
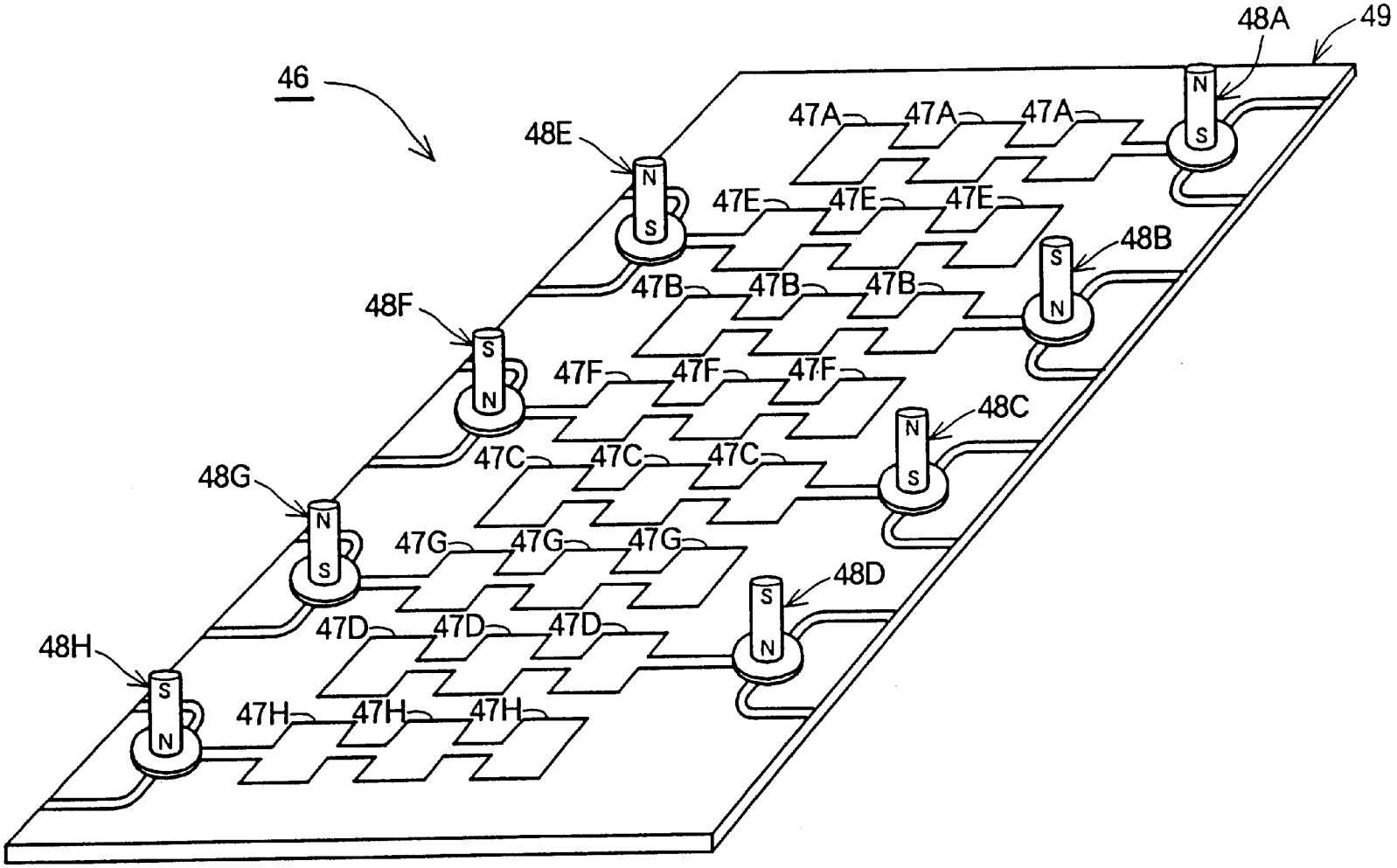
FIG. 6 is a perspective view showing a planar array antenna module including planar antenna elements and circulators arranged at a high integration density.
Figure 7:
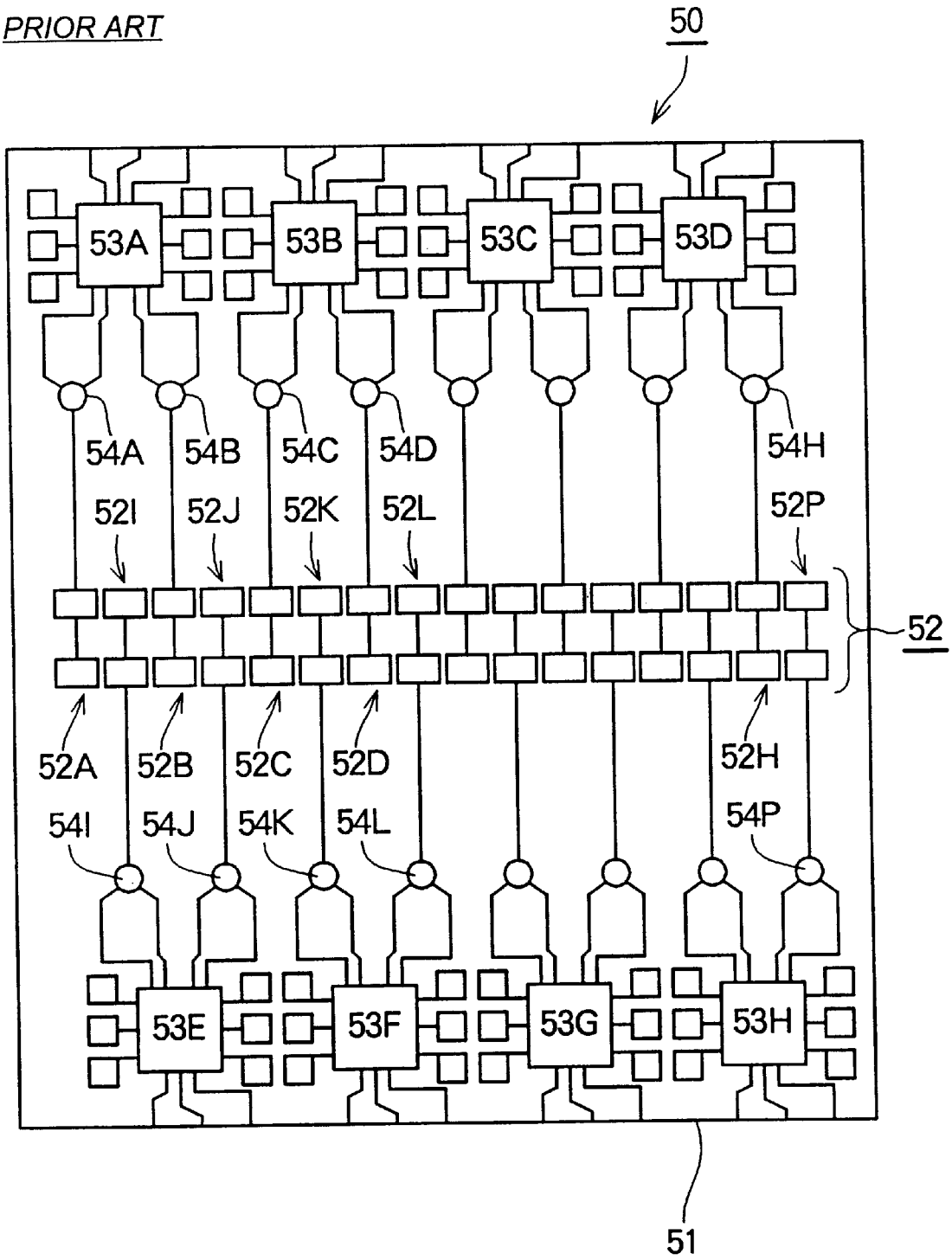
FIG. 7 PRIOR ART
FIG. 7 is a plan view showing the construction of an FM radar module.

FIG. 6 illustrates the construction of a planar array antenna module according to another embodiment of the present invention.

As shown in FIG. 6, the planar array antenna module 46 is comprised of a single dielectric substrate 49, a plurality of sets of planar antenna elements 47A–47H, each antenna set including three planar antenna elements, and a plurality of circulators 48A–48E each associated with one of the plural planar antenna element sets 47A–47H.

In the planar array antenna module 46, the planar antenna element sets 47A–47H each including a plurality (three in the illustrated embodiment) of rectangular patches connected in series with each other, and the circulators 48A–48H connected in series with the respective planar antenna element sets 47A–47H are arranged in plural rows on the single dielectric substrate 49 in a direction across feeder lines, not designated, on the substrate 49 so that DC magnetic fields in mutually opposite directions are applied to each adjacent pair of the circulators 48A–48H. The application of DC magnetic field in mutually opposite directions to the adjacent circulators 48A–48H is effective to cancel these DC magnetic fields and prevent a DC magnetic field from being generated. Thus, the planar array antenna module 46 can retain a plurality of planar antenna element sets and associated circulators that are mounted or packaged on a single dielectric substrate at a high integration density in such a manner as to clear a problem caused by the effect of a DC magnetic field.

In FIG. 6, a portion of the planar array antenna module 46 which includes each set of the planar antenna elements 47A–47H and an associated one of the circulators 48A–48E is structurally the same as the planar antenna module 10 shown in FIG. 2. As an alternative, one of the planar antenna modules 1, 20, 30 and 40 shown in FIGS. 1, 3, 4 and 5, respectively, may be used to form that portion of the planar array antenna module 46.

The planar antenna modules according to the present invention offer the following various advantages:

Since a plurality of planar antenna elements and a circulator associated therewith are mounted or packaged on a single dielectric substrate by placing two ferrite substrates or disks together with two magnets on opposite surfaces of the dielectric substrate at a portion including a feeder portion for the planar antenna elements, the planar antenna module is able to separate transmitted signals and received signals at a high separation rate. This structure makes it possible to arrange a plurality of sets of the planar antenna elements and associated circulators on a single dielectric substrate at a high integration density.

A planar antenna module provided in accordance with one preferred embodiment of the invention includes a plurality of planar antenna elements formed on a single dielectric substrate, a circulator having a ferrite substrate fitted or assembled in an opening or window formed in the dielectric substrate at a portion including a feeder line for the planar antenna elements, and a single metallic base plate on which the dielectric substrate and the ferrite substrates are mounted. With this integrated construction, the degree of separation of the transmitted signals and the received signals is further increased. The single metallic base plate may include a plurality of sets of the planar antenna elements and a corresponding number of circulators that are arranged at a high integration density.

In a planar antenna module provided in accordance with another embodiment of the present invention, a single dielectric substrate having formed thereon a plurality of planar antenna elements has one side joined with one side of a ferrite substrate on which a circulator is provided. With this integral formation, feeder lines for connecting the planar antenna elements and the circulator can be formed uniformly with the result that the impedance matching between the planar antenna element side and the circulator side is improved and high frequency wave signals can be transmitted with reduced losses.

In a planar antenna module provided in accordance with a further embodiment of the present invention, since a plurality of planar antenna elements are composed of patch elements of a conductive pattern formed on a single dielectric substrate by a thick or a thin film deposition technique, it is possible to form a plurality of planar antenna elements that are integrated at a desired position and in a desired pattern on the single dielectric substrate.

According to a still another embodiment of the present invention, a planar antenna module includes a plurality of sets of planar antenna elements, each set including a plurality of patch elements connected in series with each other, and a plurality of circulators each connected in series with a corresponding one of the planar antenna element sets. The planar antenna element sets and the circulators are arranged in plural rows over a single dielectric substrate such that DC magnetic fields in mutually opposite directions are applied to each pair of adjacent circulators. The application of DC magnetic fields in mutually opposite directions to the adjacent circulators is effective to cancel these DC magnetic field and prevent a DC magnetic field from being generated even when a large number of planar antenna element sets are mounted or packaged at a high integration density on the single dielectric substrate together with associated circulators.

It should readily be appreciated by those skilled in the art that the planar antenna module according to the present invention may be combined with a secondary radiator of an offset defocused parabolic antenna or a lens radiator to thereby provide a primary radiator.

Obviously, various minor changes and modifications of the present invention are possible in the light of the above teaching. It is therefore to be understood that within the scope of the appended claims the invention may be practiced otherwise than as specifically described.

What is claimed is:

1. A planar antenna module, comprising a single dielectric substrate having a plurality of planar antenna elements formed on one surface of said dielectric substrate;

a ferrite substrate provided with a circulator; and the dielectric substrate having an opening formed therein and said ferrite substrate being disposed in said opening, and said dielectric substrate and said ferrite substrate being integrally joined together to form an integral unit.

2. A planar antenna module according to claim 1, wherein said planar antenna elements are each composed of a patch element of a conductive pattern formed on said dielectric substrate by a thick or a thin film deposition technique.

3. A planar antenna module according to claim 1, wherein said single dielectric substrate is provided with a plurality of sets of said planar antenna elements formed thereon, and a corresponding number of said circulators connected in series with the respective planar antenna element sets, each planar antenna element set including a plurality of patch elements connected in series with each other, said planar antenna element sets and said circulators being arranged in plural rows in a transverse direction of said dielectric substrate such that DC magnetic fields in mutually opposite directions are applied to each adjacent pair of the circulators.

4. A planar antenna module, comprising:

a single dielectric substrate;

a plurality of planar antenna elements formed on said dielectric substrate;

a circulator formed by two ferrite pieces and two magnets attached thereto, said ferrite pieces being attached to opposite surfaces of said dielectric substrate at a portion including a feeder line for said planar antenna elements, said single dielectric substrate being provided with a plurality of sets of said planar antenna elements formed thereon, and a corresponding number of said circulators are connected in series with the respective planar antenna element sets, each planar antenna element set including a plurality of patch elements connected in series with each other, said planar antenna element sets and said circulators being arranged in plural rows in a transverse direction of said dielectric substrate such that DC magnetic fields in mutually opposite directions are applied to each adjacent pair of the circulators.

5. A planar antenna module according to claim 4, wherein said planar antenna elements are each composed of a patch element of a conductive pattern formed on said dielectric substrate by a thick or a thin film deposition technique.

* * * * *